United States Patent [19]

Horowitz

[11] 4,106,834

[45] Aug. 15, 1978

[54] ELECTRICAL CONNECTOR

[75] Inventor: Charles Horowitz, Niles, Ill.

[73] Assignee: Sloan Valve Company, Franklin Park, Ill.

[21] Appl. No.: 801,098

[22] Filed: May 27, 1977

Related U.S. Application Data

[63] Continuation-in-part of Ser. No. 701,085, Jun. 30, 1976, abandoned.

[51] Int. Cl.[2] ..... H01R 13/44

[52] U.S. Cl. ..... 339/44 M; 339/136 M; 339/192 R; 339/220 R

[58] Field of Search ..... 339/44, 10, 107, 132–136, 339/138–142, 183, 186 M, 191, 192, 195, 196, 215, 217, 219, 220

[56] References Cited

U.S. PATENT DOCUMENTS

| | | | |
|---|---|---|---|
| Re. 18,193 | 9/1931 | Kollath | 339/107 |
| 2,337,692 | 12/1943 | Todd | 339/221 M |
| 2,593,182 | 4/1952 | Quackenbush | 339/44 M |
| 2,610,222 | 9/1952 | Burtt et al. | 339/195 M |
| 2,691,771 | 10/1954 | Burtt et al. | 339/217 J |
| 3,887,256 | 6/1975 | Klimek et al. | 339/44 M |
| 4,037,907 | 7/1977 | Klimek et al. | 339/44 M |

FOREIGN PATENT DOCUMENTS

| | | | |
|---|---|---|---|
| 246,382 | 5/1963 | Australia | 339/107 |
| 740,549 | 8/1966 | Canada | 339/44 R |
| 1,403,666 | 5/1965 | France | 339/44 M |

*Primary Examiner*—Neil Abrams

*Attorney, Agent, or Firm*—Kinzer, Plyer, Dorn & McEachran

[57] ABSTRACT

An electrical connector for use on tractor-trailer vehicles includes a receptacle and plug. The receptacle housing has a thickened portion and ribs reinforcing the thickened portion to prevent deformation of the receptacle due to vibration of the attached cable. The receptacle housing has an extended body portion to provide a deeper support for an inserted plug. The plug uses non-rotatably mounted bushings to form the female connectors, which bushings are staked, one to another. A cable mounting collar is attached to the plug housing in such a manner that its mounting groove always faces in a downward direction to prevent moisture from passing into the connector plug.

7 Claims, 5 Drawing Figures fig.1.
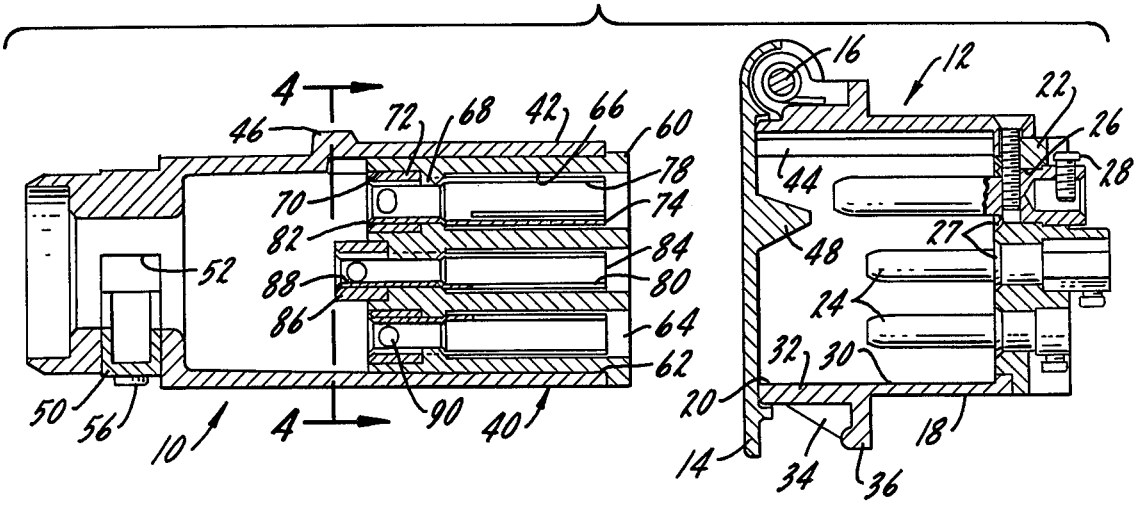
fig.2.
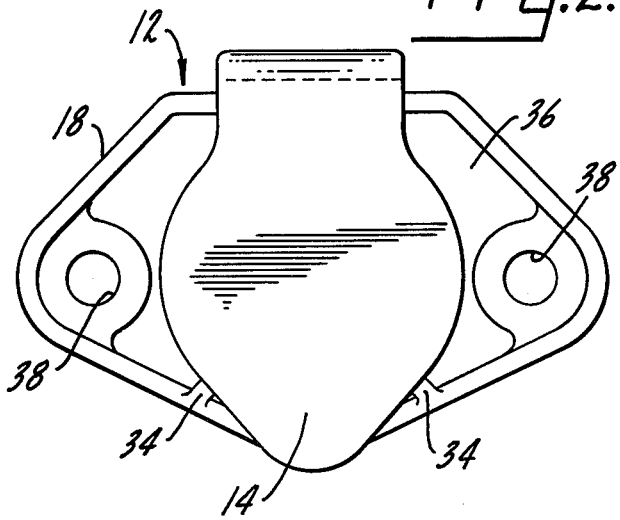
fig.3.
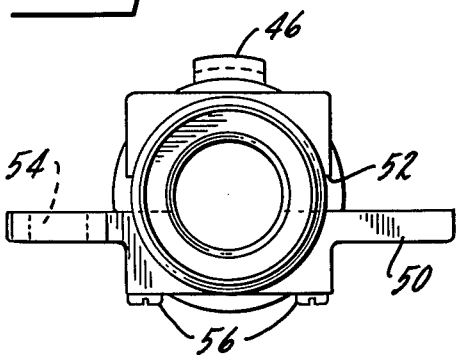
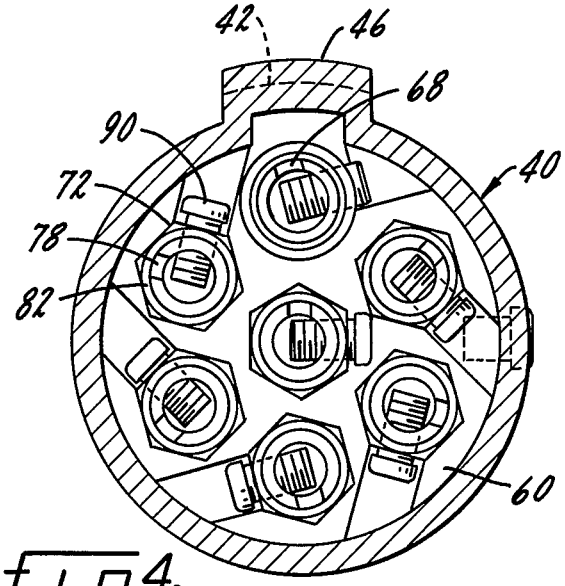
fig.4.
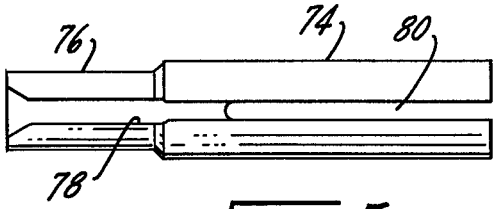
fig.5.

ELECTRICAL CONNECTOR

SUMMARY OF THE INVENTION

This application is a continuation-in-part of my copending application Ser. No. 701,085, filed Jun. 30, 1976, now abandoned.

The present invention relates to electrical connectors for use on tractor-trailer vehicles.

One purpose of the invention is a receptacle housing for use in a connector of the type described, which housing has a lengthened and reinforced body to prevent the plug from falling out and to prevent vibration from the weight of the plug and its cable from deforming the receptacle housing.

Another purpose is an electrical connector having a greater proportional engagement between the connector plug and connector receptacle to prevent the connector receptacle from deforming.

A further purpose is an electrical connector having a plug which can be inserted an increased distance within the receptacle without a corresponding increase of the projection of the receptacle into the trailer housing.

Another purpose is a structure of the type described including non-rotatably mounted bushings forming the female contact members in the connector plug.

Another purpose is a connector plug having a mounting collar which fits within a groove in the plug housing, which groove is always facing in a downward direction, when mounted, so as to prevent moisture from passing into the plug interior.

Other purposes will appear in the ensuing specification, drawings and claims.

BRIEF DESCRIPTION OF THE DRAWINGS

The invention is illustrated diagrammatically in the following drawings wherein:

FIG. 1 is a sectional side elevation with the plug and receptacle pulled apart, FIG. 2 is an end view of the receptacle, FIG. 3 is an end view of the plug, FIG. 4 is a section along plane 4—4 of the plug of FIG. 1, and FIG. 5 is a detail of one of the plug bushings.

DESCRIPTION OF THE PREFERRED EMBODIMENT

In FIG. 1 a plug is indicated generally at 10 and is positioned for insertion within a receptacle 12. Receptacle 12 has a cover 14, pivotally mounted, as at 16, which cover is opened when the plug is inserted therein.

Considering the receptacle illustrated in detail in FIG. 1, there is a receptacle housing 18 whose open end 20 is closed by cover 14. The opposite end of housing 18 is closed by an insert 22 having a plurality of contact pins 24 mounted therein. Insert 22 has openings or the like 26 which receive the contact pins and set screws or the like 28 are used to fasten the contact pins to appropriate electrical cable. The inserts are retained within the receptacle itself by staking, as at 27.

With the heavier cable now being used in tractor-trailer vehicle electrical systems, the additional weight on the plug has at times caused the plug to fall out of the receptacle. Also at times vibration from the vehicle has deformed the receptacle wall. This has been due to the excessive weight of the cable attached to the rear end of the plug exerting a force on the receptacle wall. To reduce this force it was necessary to reduce the distance between the cable end of the plug and its fulcrum point at opening 20 of the receptacle. Accordingly, cylindrical wall 30 of housing 18 has been axially lengthened to provide a longer support surface, reducing the cantilever extension of the rear end of the plug.

In providing greater proportional engagement between receptacle and plug by lengthening the receptacle wall, it is not desirable that the receptacle now protrude a corresponding greater distance into the trailer housing. This is because the space of the trailer interior is used for transporting cargo. The projection of the receptacle into the trailer not only reduces the available space, but exposes the receptacle and its electrical connections to possible damage by the shifting or the loading of cargo. With this in mind, tubular extension 32 is located forward of outwardly extending mounting flange 36, so that a greater engagement between receptacle and plug is accomplished without increasing the projection of the receptacle into the trailer interior. It has been found that this is best accomplished by tubular extension 32 being of a length approximately equal to $\frac{1}{4}$ to $\frac{1}{2}$ of the overall length of the now-extended receptacle. A shorter extension does not provide sufficient support to prevent the receptacle wall from deforming. While a longer extension does not prevent deformation of the receptacle, it places too great a stress on the trailer body to adequately support the overhanging receptacle, plug and cable.

Additional steps have been taken to prevent the receptacle from deforming. There is a thickened portion at tubular extension 32 of cylindrical wall 30 which provides greater reinforcement adjacent the open end 20 which receives the plug, and there may be a plurality, for example three, ribs 34 which are integral with housing 18 and with mounting flange 36. Note particularly FIG. 2. Flange 36 may have conventional openings 38 for use in attaching the receptacle to the vehicle body.

Turning to the plug, as illustrated in FIGS. 1, 3 and 4, there is a plug housing 40, generally cylindrical in form, and having an exterior axially extending key 42 which fits within a mating groove 44 in the interior of receptacle housing 18. Key 42 has an outwardly-extending projection 46 which cooperates with member 48 on the cover 14 to interlock the plug within the receptacle when the two are assembled together. Key 42 and groove 44 are particularly arranged to align the plug and receptacle relative to the mating electrical contacts.

A collar 50 is positioned within a radially extending groove 52 at one end of housing 40. Collar 50 has an opening 54 in one side thereof for use in hanging the collar and thus the plug upon a convenient portion of the vehicle body.

Of particular importance is the fact that groove 52 faces in a downward direction, as shown in the drawings, or to the side opposite that of key 42. In practice, the receptacle and plug are arranged so that the key on the plug and the mating groove on the receptacle face in an upward direction. Thus, groove 52 will always face downward, which will prevent any moisture which might pass along the sides of the groove from reaching the interior of the plug housing. The primary purpose of collar 50 is to attach the cable to the plug. Screws 56 are threaded into mating bosses in the plug housing so as to tighten the collar upon the cable position within the plug. Collar 50 also provides a hand grip with opening 54 being used to mount the plug as described.

An insert 60 is positioned in open end 62 of housing 42 and is generally cylindrical in form. There are a plurality of axially extending passages 64 in insert 60, which passages mount the female contacts which will mate with contact pins 24 in the receptacle. Each passage 64 includes a first portion 66, an intermediate key 68 and a second portion 70, hex-shaped in cross section, and slightly larger in diameter than portion 66. A hex-shaped bushing 72 is positioned within hex-shaped passage portion 70 providing a non-rotatable mounting for the bushing. An elongated bushing 74, shown in detail in FIG. 5, is positioned within passages portion 66 and itself has a reduced diameter portion 76 which fits within hex-shaped bushing 72. Bushing 74 may have an axially extending slot 78 formed when the bushing is rolled from flat stock. Slot 78 will be aligned with key 68 when the bushing is inserted from one end of insert 60 to the position shown in FIG. 4. Thus, the combination of key 68 and slot 78 provides a non-rotatable mounting for bushing 74. Bushing 74 may further have an axially extending slot 80 which provides for flexibility of the bushing to accomodate insertion of contact pins 24.

After bushing 74 has first been inserted in insert 60, bushing 72 is then positioned outside of bushing portion 76 and within hex-shaped passage portion 70. A mechanical staking of bushing portion 76 to bushing 72 then takes place at the co-extensive ends, as indicated at 82, in FIG. 1. Thus, the two bushings are mechanically fastened together.

The passage and bushing combinations described above relate to those female contacts of the plug with the exception of the center contact and one peripheral contact. Again, looking particularly at FIG. 1 in the center contact, bushing 84 and bushing 86 are the same as described above, except that bushing 84 has a portion 88 of greater axial extent than bushing portion 76. In this case, hex-shaped bushing 86 is not recessed to the same depth as bushings 72 described above. In other respects the construction is the same. In all cases there are set screws 90 which are used to fasten the electrical wires to the bushings.

Of particular advantage in the bushing structure shown is the fact that the bushings forming the female electrical contacts are non-rotatable relative to the housing insert permitting drilling and tapping of the bushings after they have been positioned. Also, there is correct alignment between the bushings and the insert providing for uniformity of the overall structure.

Whereas the preferred form of the invention has been shown and described herein, it should be realized that there may be many modifications, substitutions and alterations thereto.

The embodiments of the invention in which an exclusive property or privilege is claimed are defined as follows:

1. In an electrical connector for use with tractor-trailer vehicles, a receptacle and plug, said receptacle including a housing, a cover pivotally attached to said housing and a plurality of contact pins mounted in said housing and extending toward said cover, said plug including a housing, a plurality of axially extending passages in one end of said housing adapted for alignment with and reception of said contact pins when said plug is inserted in said receptacle, a first bushing positioned in each passage, an axially extending slot in each first bushing, and a key extending into each passage through the bushing slot for preventing rotation of each first bushing within its passage, each passage including an enlarged portion, a second bushing positioned within each enlarged passage portion and positioned exteriorly of said first bushing, said second bushing exterior and enlarged passage portion cooperating to provide a non-rotatable mounting for said second bushing, a portion of said first bushing being positioned within said second bushing and being mechanically interlocked therewith, said second bushing including means to fasten an electrical wire thereto.

2. The structure of claim 1 further characterized by and including a plug housing insert, each of said axially extending passages being formed in said insert.

3. The structure of claim 2 further characterized in that a portion of said first bushing is staked over upon the exteriorly positioned second bushing.

4. The structure of claim 1 further characterized in that said second bushing has a hex-shaped exterior, with said enlarged passage portion having a hex shape.

5. The structure of claim 1 further characterized by and including exterior supporting ribs on said receptacle housing, said ribs being positioned adjacent the cover end of said housing.

6. The structure of claim 5 further characterized by and including a thickened portion for said receptacle housing, said ribs being integral with said thickened portion.

7. The structure of claim 1 further characterized in that said receptacle housing includes an outwardly-extending mounting flange, and a tubular extension of said housing beyond said flange for providing support for an inserted plug.

* * * * *